United States Patent [19]

Leifeld et al.

[11] 4,244,082

[45] Jan. 13, 1981

[54] ARRANGEMENT FOR MIXING TEXTILE FIBER FLAKES

[75] Inventors: Ferdinand Leifeld, Kempen; Walter M. Oellers; Johannes W. Reiche, both of Monchen-Gladbach, all of Fed. Rep. of Germany

[73] Assignee: Trutzschler GmbH & Co. KG, Munchen-Gladbach, Fed. Rep. of Germany

[21] Appl. No.: 22,271

[22] Filed: Mar. 20, 1979

[30] Foreign Application Priority Data

Apr. 10, 1978 [DE] Fed. Rep. of Germany ..... 2815420

[51] Int. Cl.[3] ..... D01G 7/04

[52] U.S. Cl. ..... 19/81; 19/145.5; 241/101 A

[58] Field of Search ..... 19/80 R, 80 A, 81, 82, 19/83, 85, 86, 97.5, 105, 145.5, 239, 240, 241; 209/599; 73/78, 81, 85; 214/152; 241/101 A

[56] References Cited

U.S. PATENT DOCUMENTS 3,951,282 4/1976 Keller ..... 19/80 R

FOREIGN PATENT DOCUMENTS 2731811 1/1979 Fed. Rep. of Germany ..... 19/80 A
43-16911 7/1968 Japan ..... 19/80 R
46-1340 1/1971 Japan ..... 19/80 R
287553 1/1971 U.S.S.R. ..... 19/80 R

*Primary Examiner*—Louis Rimrodt

[57] ABSTRACT

An arrangement for mixing textile fiber in set quantity ratios, with at least two conveyers and at least two weighing feeders with scale tanks. Each conveyer has one weighing feeder with scale tank for delivering fiber flakes. Each conveyer has one conveyer roller and one breakup roller acting jointly for receiving the fiber flakes, and all conveyer rollers and breakup rollers are connected to a common flake suction device. Two horizontal endless conveyer belts may be used as conveyers. The rotary speed of the conveyers is continuously variable. The upper side of the conveyers runs towards the flake suction device. The conveyer rollers are located near belt rollers on the conveyers. Conveyer rollers and belt rollers have opposite directions of rotation, while breakup rollers and belt rollers rotate in the same direction. Air shield elements and the flake suction device may form an injector nozzle.

12 Claims, 1 Drawing Figure

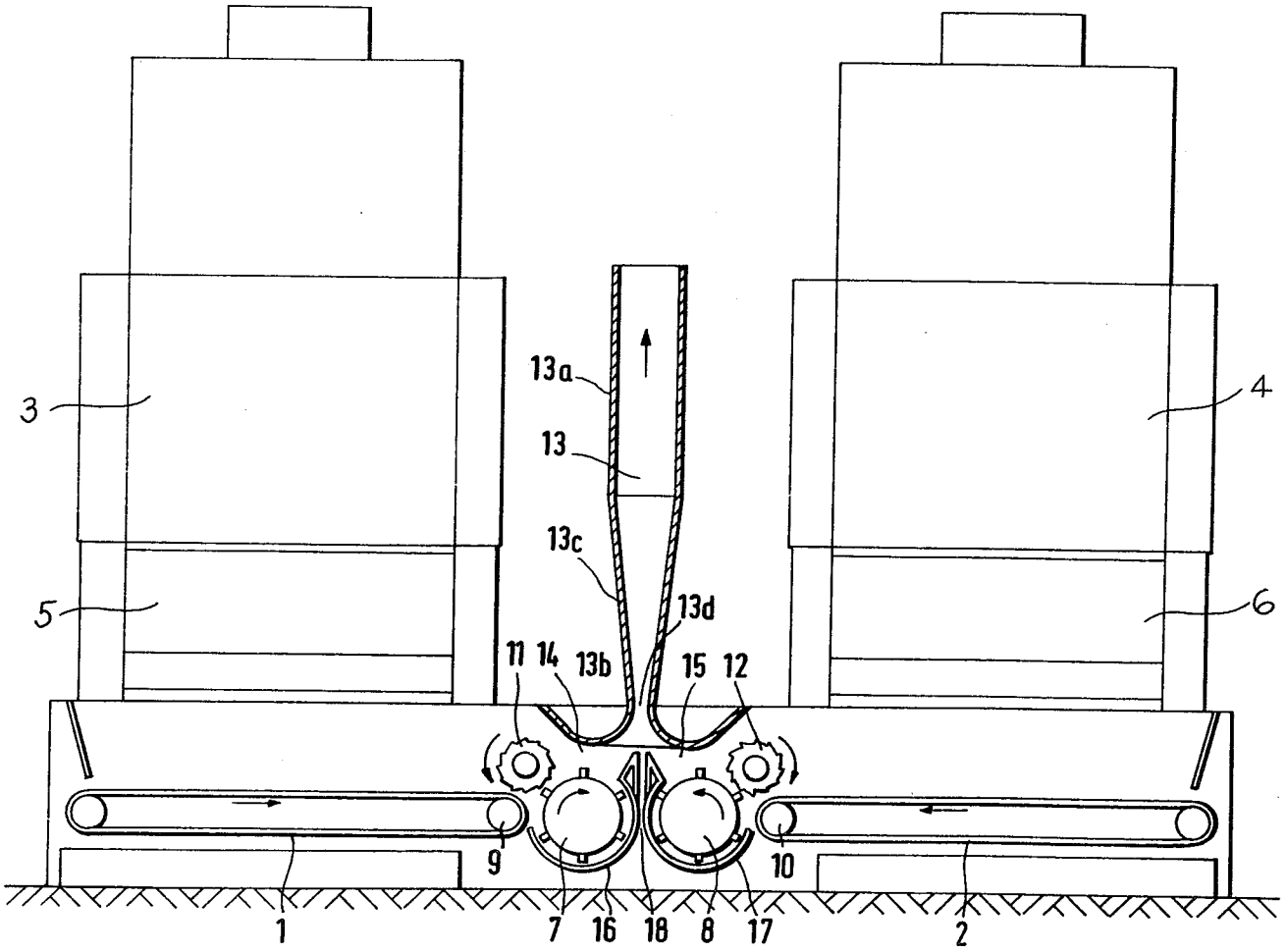
4
6
2
10
17
12
8
13d
15
18
16
13a
13
13c
13b
14
7
11
9
1
3
5

ARRANGEMENT FOR MIXING TEXTILE FIBER FLAKES

BACKGROUND OF THE INVENTION

The present invention relates to an arrangement for mixing textile fiber flakes in set quantity ratios, with at least one conveyer and at least two weighing feeders with weighing tanks.

In a known arrangement, a single conveyer, for example, an endless conveyer belt, is arranged underneath the scale tanks and delivers the material to a breakup arrangement. Between the drops of the weighing tanks, the conveyer belt advances only by the width of a weighing tank. From the individual drops result closed layers of mixture components which are on top of each other. Pressure tables compress the layers. The conveyer belt, in conjunction with a pressure table located above its end, delivers the layers to a breakup roller with serrated slats. The breakup roller receives the horizontal layers in a vertical direction, mixes them intensively and drops the mixture into an air current which delivers it to the next machine. This arrangement permits the production of good mixtures. However, the formation of small flakes, particularly for fibers over 60 mm in length, is limited because of the difficult breakup of the multiple superposed layers.

Accordingly, it is an object of the present invention to provide an arrangment of the above-described type which permits the production of a mixture with small flakes.

Another object of the present invention is to provide an arrangement of the foregoing character which is substantially simple in construction and may be economically fabricated.

A further object of the present invention is to provide an arrangement as described, which may be readily maintained in service and which has a substantially long operating life.

SUMMARY OF THE INVENTION

The present invention is based on the concept of delivering the components individually to the breakup location. The weighing feeders deliver the preset flake quantities simultaneously to the running conveyer belts. Because at least two conveyers are provided, with each of these conveyers having only one weighing feeder with scale tank, only one layer is deposited on the conveyer and further compressed by the conveyor roller. In the manner, a comparatively thin layer, easily broken down into small flakes, is delivered to the breakup roller. In contrast with the known arrangement, at first only individual layers are formed and broken up into small flakes; these flakes are then brought together in a common flake suction device and mixed there. This achieves a particularly homogenous mixing for which small flakes in particular are advantageous. If dusty material is to be processed, the flake suction arrangements prevents dust from exiting in the spinning room.

Modern textile fabrics are often made of yarns which are a mixture of fibers of two kinds, for example, natural fiber, such as wool or cotton and synthetic fiber such as polyester, polyamide, viscose, acetate, etc. To produce these fiber mixtures, two horizontal endless conveyer belts are used. The speed of the conveyer belts is identical and can be varied continuously. The upper sides of the conveyer belts all rotate in the direction of the common flake suction device, i.e., the flake streams flow towards each other so that the flake suction arrangement can be centrallly located.

The conveyer roller is preferably designed as a pressure roller and located in the vicinity of a roller of the conveyer belt. Hence the material layer is compressed into a thin layer immediately before breakup by the breakup rollers so that the formation of small flakes is encouraged. The conveyer rollers are toothed and expediently located in the entries of the flake suction device. The conveyer rollers and the rollers rotate in opposite directions so that the material layers supplied are clamped and transported between them. The breakup roller and the roller are placed horizontally one behind the other. It is of advantage if the breakup rollers and the rollers rotate in the same direction so that after breakup the flakes are thrown in the suction direction.

According to a preferred embodiment, the flake suction device is formed similar to an injector nozzle. A vertical air current is sucked from the region underneath the conveyer belts. The flakes produced by the breakup rollers are delivered to this air current immediately ahead of the narrowest location of the nozzle. At this narrowest point there is acceleration which acts on the flakes in such a way that an oriented mixing takes place. Preferably the breakup rollers are shielded from below against the vertical air current by air shields, for example, of sheet metal. According to another advantageous embodiment, the conveyer belt runs at a speed such that during a filling period the conveyor belt advances by less than the width of the weighing container. This ensures that no gaps develop in the layer on the conveyer belt.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

A partial sectional elevational view of showing the essential components of the present invention and their interrelationships.

DESCRIPTION OF THE PREFERRED EMBODIMENTS

Referring to the drawing, there is shown two conveyer belts 1, 2 which are arranged horizontally in one plane and are spaced apart. Conveyer belts 1, 2 are driven by a common drive (not shown) at identical regulatable speed. The belt roller 9 of conveyer belt 1 rotates clockwise, belt roller 10 of conveyer belt 2 rotates counterclockwise. Hence, the rotation direction of conveyer belts 1, 2 is such that the layers deposited on the conveyer belts 1, 2 move towards each other. The belt speed is 0.18 to 0.036 meters/second, depending on the material requirement of the machine following. Above each of the conveyer belts 1, 2 is a weighing feeder 3, 4 with associate scale tanks 5, 6. In the space between the conveyer belts 1, 2 each belt has breakup rollers 7 and 8, equipped with serrated slats, to serve as beater roller. The breakup roller 7 rotates clockwise, the breakup roller 8 rotates counterclockwise; the speed is 530 revolutions per minute. In the zone above the rollers 9, 10 of conveyer belts 1, 2 and of breakup rollers 7, 8 two conveyer rollers 11, 12 equipped with toothed rings are provided as pressure rollers. Conveyer roller 11 rotates counterclockwise, conveyer roller 12 rotates clockwise. The serrated slats of the breakup rollers 7, 8 reach into the tracks between the rings of conveyer rollers 11, 12. Above the two breakup rollers 7, 8 a suction tube 13 shaped like an injector nozzle is provided as flake withdrawal device. This suction tube 13 is directed upward and has at its opening, facing the breakup rollers 7, 8 a trumpet-shaped section 13*b*, forming two entries, 14, 15. Between the cylindrical section 13*a* and the trumpet-shaped part 13*b* is a conic section 13*c* with a restriction 13*d*. On their peripheral areas, facing away from entries 14, 15, the breakup rollers 7, 8 have air shields 16, 17. In the space between the air shields 16, 17 is a space 18 for supplying an air current.

During operation, the two conveyer belts 1, 2 are supplied by weighing feeders 3, 4 which feeds a component of the fiber mixture to be formed in accordance to a predetermined weight ratio into an associated scale tank 5, 6 with set or predetermined amounts. The speed of the conveyer belts 1, 2 is the same, with the filling time of the scale tanks 5, 6 being below the belt run distance by one tank width in time. The material deposition and the conveyer belts 1, 2 are stopped when the machine following does not demand material. The material quantity received by the conveyer belts upon arrival spreads across the width so that a closed material layer develops. The conveyer rollers 11, 12 are arranged in connection with the rotary directions in relation to belt rollers 9, 10 in such a way that the layer conveyed on conveyer belts 1, 2 is squeezed or clamped and moved between the conveyer rollers 11, 12 and belt rollers 9, 10. From these clamping points, the fiber layers are delivered to breakup rollers 7 and 8, respectively. In conjunction with the toothed rings of conveyer rollers 11, 12 and the serrated slats of breakup rollers 7, 8, the two fiber components are broken up into flakes in accordance with the predetermined ratio. Through the indicated rotary direction of breakup rollers 7, 8, the broken-up flakes are moved through the entries 14, 15 into the trumpet-shaped section 13*d* of suction tube 13. Here the two different flake flows are seized and mixed by an air current sucked through the space 18, and sucked through the restriction 13*d* and the conic section 13*c* into the cylindrical part 13*a* of suction tube 13.

Without further analysis, the foregoing will so fully reveal the gist of the present invention so that others can, by applying current knowledge, readily adapt it for various applications without omitting features that, from the standpoint of prior art, fairly constitute characterisitics of the generic or specific aspects of this invention, therefore, such adaptations should and are intended to be comprehended within the meaning and range of equivalents of the following claims.

What is claimed is:

1. An arrangement for mixing textile fiber flakes in predetermined quantity ratios, comprising: at least two conveyers; at least two weighing feeders with associated scale tanks, each of said conveyers having one weighing feeder with one of said scale tanks for delivering fiber flakes; conveyer rollers and breakup rollers; each conveyer having one conveyer roller and one breakup roller cooperating jointly for receiving said textile fiber flakes; flake suction means; all of said conveyer rollers and said breakup rollers being connected to said flake suction means.

2. An arrangement as defined in claim 1 wherein said conveyers comprise horizontal endless conveyer belts.

3. An arrangement as defined in claim 1 wherein the rotary speed of said conveyers is continuously variable.

4. An arrangement as defined in claim 1 wherein an upper side of said conveyers runs towards said flake suction means.

5. An arrangment as defined in claim 1 including belt rollers on said conveyer, said belt rollers being located near said conveyer rollers.

6. An arrangement as defined in claim 5 wherein said conveyer rollers and said belt rollers have opposite directions of rotation.

7. An arrangement as defined in claim 5 wherein said breakup rollers and said belt rollers rotate in the same direction.

8. An arrangement as defined in claim 1 including the air shield elements, said air shield elements and said flake suction means forming an injector nozzle.

9. An arrangement as defined in claim 8 wherein said air shield elements are associated with said breakup rollers.

10. An arrangement as defined in claim 1 wherein said conveyers rotate at a speed such that during one filling period said conveyer has advanced by less than one width of said scale tank.

11. An arrangement as defined in claim 1 including belt rollers on said conveyers, said belt rollers being located near said conveyer rollers, said conveyers comprising horizontal endless conveyer belts, said conveyers having a rotary speed which is continuously variable, an upper side of said conveyers running towards said flake suction means, said conveyer rollers and said belt rollers having opposite directions of rotation, said breakup rollers and said belt rollers rotating in the same direction, air shield elements forming an injector nozzle with said flake suction means, said air shield elements being associated with said breakup rollers, said conveyers rotating at a speed so that during one filling period said conveyer has advanced by less than one width of said scale tank.

12. An arrangement as defined in claim 1 including belt rollers on said conveyers, said belt rollers being located near said conveyer rollers, said breakup rollers and said belt rollers rotating in the same direction, air shield elements forming an injector nozzle with said flake suction means, said air shield elements being associated with said breakup rollers, said conveyers rotating at a speed so that during one filling period said conveyer has advanced by less than one width of said scale tank.

* * * * *